US005235963A

United States Patent [19]

Strause

[11] Patent Number: 5,235,963

[45] Date of Patent: Aug. 17, 1993

[54] EXHAUST DUCT CLEANING SYSTEM

[76] Inventor: James F. Strause, 4652 Palo Verde, Lakewood, Calif. 90713

[21] Appl. No.: 926,938

[22] Filed: Aug. 10, 1992

[51] Int. Cl.[5] ..... F24C 15/20

[52] U.S. Cl. ..... 126/299 E; 134/167 C; 134/172

[58] Field of Search ..... 126/299 E, 299 R, 299 D; 134/167 C, 104.1, 172; 169/59, 65; 55/DIG. 36

[56] References Cited

U.S. PATENT DOCUMENTS

| | | | |
|---|---|---|---|
| 3,433,146 | 3/1969 | Russell | 126/299 E |
| 3,525,314 | 8/1970 | Clughan | 134/167 C |
| 3,865,193 | 2/1975 | Hall | 169/65 |
| 4,066,064 | 1/1978 | Vandas | 126/299 E |
| 4,231,769 | 11/1980 | Anlrich | 126/299 E |
| 4,259,945 | 4/1981 | Lawson | 126/299 E |
| 4,351,652 | 9/1982 | Wisting | 126/299 E |
| 4,442,899 | 4/1984 | Zublin | 134/167 C |
| 4,784,114 | 11/1988 | Muckler et al. | 126/299 E |
| 4,822,385 | 4/1989 | Strege et al. | 126/299 E |
| 5,042,457 | 8/1991 | Gallagher | 126/299 E |

FOREIGN PATENT DOCUMENTS

| | | | |
|---|---|---|---|
| 379295 | 7/1973 | U.S.S.R. | 134/167 C |

*Primary Examiner*—James C. Yeung
*Attorney, Agent, or Firm*—Gifford, Groh, Sprinkle, Patmore and Anderson

[57] ABSTRACT

A cleaning system for exhaust ducts of cooking hoods. A hot water cleaning liquid is introduced at high pressure to a spray manifold in an exhaust duct. The manifold conforms to the internal perimeter of the exhaust duct and has nozzles for directing the cleaning fluid. The manifold is moved along the length of the duct to cover the internal surface area of the duct.

17 Claims, 3 Drawing Sheets

EXHAUST DUCT CLEANING SYSTEM

BACKGROUND OF THE INVENTION

1. Field of the Invention

This invention relates to an exhaust duct cleaning system. More particularly, this invention relates to a cleaning system for use in an exhaust duct of a cooking unit in which the system is permanently installed in the exhaust duct and is operated on an automatic time cycle. The system is particularly designed for use in commercial establishments such as restaurants where the cooking facilities are used continuously so that grease buildup becomes a problem in the exhaust duct.

2. Description of the Prior Art

There is a wide variety of equipment available on the market for cleaning exhaust ducts and hoods in restaurants and other cooking establishments.

The vast majority of exhaust systems are cleaned on an unscheduled basis, usually when the grease and sludge buildup has become so great that it affects proper ventilation or has become a fire or health hazard. Most of the cleaning is done by hand using long-handled scrapers, and the entire process is a dirty, messy job. The cleaning must be done in the restaurant off hours, and the effectiveness of such cleaning often leaves much to be desired. A good employee on this job usually has a short tenure.

The use of commercial cleaning companies also has many drawbacks. Again, the job must be done during off hours, and problems associated with grease buildup are often exasperated by only scheduling cleaning "when needed." Commercial cleaning can be more effective than normal in-house cleaning because of the use of special equipment such as steam cleaning guns and the like, but extreme care has to be exercised by experienced personnel so as not create other hazards such as grease and water on floors and clogged drains.

Various attempts have been made to install equipment permanently in the hoods and ducts. A common technique is to employ baffles to create a tortuous or zigzag air path above the hood so that the grease-laden air travelling through the path or channels deposits the grease on the baffles to be removed by a water spray. The channels and water spray can be integrally mounted in the duct, or the zigzag channel portion can be supplied as part of a removable cartridge for spray or immersion cleaning when the cartridge is removed from the exhaust system. Many problems are associated with this type of equipment, not the least of which is the increased pressure drop experienced and the increased fan size required.

Other systems utilize spray nozzles at strategic locations within the exhaust duct pointed at given spots in the duct or at particular baffling, which systems depend primarily on the gravity flow downward of the cleaning liquid to perform the primary cleaning function rather than the energy of impinging jets.

Other systems utilize a nozzle pipe which extends along the axis of the exhaust duct so as to disperse the spray along a major part of the length of the duct. Some of these longitudinally extending pipes also have been caused to rotate so as to spray around the interior perimeter of the exhaust pipe. However, the difficulty with both of these systems is that the spray must travel a considerable distance before it impinges upon the wall of the duct, thus losing energy, and they invariably do not cover the entire area with direct impingement.

While rotation of the nozzle pipe can aid to some extent, it will only approximate circumferential coverage in a round duct configuration and will be totally inadequate in a rectangular duct.

A further improvement in the rotating nozzle pipe configuration has been to branch off from the axis of the exhaust duct to bring the pipe closer to the inner periphery of the exhaust duct as it is rotated. While this improves the efficacy of a round exhaust duct system, it still does not insure longitudinal coverage, and aggravates a situation where the duct cross-section is rectangular.

SUMMARY OF THE INVENTION

The present invention is directed to an exhaust duct cleaning system which is built into the exhaust duct offering obvious advantages over the various hand cleaning techniques and surmounts the difficulties and inadequacies of prior art installed equipment.

The new system includes a manifold which conforms to the internal perimeter of the exhaust duct, so that if the duct has a rectangular cross section, the manifold will have an outer rectangular periphery closely adjacent to the internal perimeter of the duct. Most commonly a rectangular manifold is constructed with two opposed parallel pipes extending the width of the duct joined to two spaced parallel pipes extending the depth of the duct. Pressurized cleaning liquid is delivered to the manifold by a hose, and the manifold is caused to move up and down the length of the duct. Usually equally spaced nozzles are located on the outer periphery of the manifold to direct cleaning liquid against the internal surface of the exhaust duct as the manifold is moved in the duct. Thus, the entire perimeter of the duct along its entire length is exposed to the cleaning fluid to remove grease and other collected matter. A pump is used to deliver the hot water with or without detergents and rust inhibitors at an elevated pressure, at city water pressuring at 3,000 p.s.i. depending on local conditions. An automatic control is used so that a cleaning cycle can be periodically initiated during periods in which the exhaust system is not in use.

With the use of an automatic control system which includes solenoid operated valves, manifolding, timers and control logic, the spray manifold can be caused to traverse the exhaust duct in various cycles. For example, some of the nozzles on the manifold can be at a wider spacing and a downward dispersion angle to disperse a hot water with a detergent or other chemical cleaning agents at a relatively low pressure during a first pass which allows a dissolving action to commence. This "soak" cycle can also be accomplished by spraying with the manifold in its stationary storage and starting position at the top of the duct, allowing the cleaning fluid to flow by gravity. A pass then can be made utilizing a higher manifold pressure and closer spaced nozzles to impinge on the already softened or partially dissolved grease contained on surface of the duct.

A stationary spray nozzle can be located adjacent to the exhaust fan to spray cleaning liquid on the fan blades. The automatic control system can, for example, cause the exhaust fan to rotate during the fan blade spraying cycle and then cause it to shut off during the duct cleaning procedure.

Provisions can also be made for the use of a manual washdown gun to clean specific portions of the duct and the hood. The gun can also be conveniently used to clean under the hood and on other equipment in the establishment.

In a substantially vertical exhaust duct system, the cleaning manifold can be lowered from a position out of the flow path of the exhaust fan through the duct by gravity. On other systems that have slanted or even horizontal duct sections, or where a more positive drive is required in a vertical duct, the manifold can be caused to move by the use of a cable/chain and pulley/-sprocket drive system. The drive motor can be located at either extremity of the duct being cleaned. Most often the top of the duct is the most convenient and the only place where sufficient space is available. Where the manifold is allowed to descend by gravity, the motor will be located at the upper end of the exhaust duct on the axis of the hose take-up reel to pull the manifold upward by the hose into its storage position. Where the exhaust fan is located at the top end of a vertical exhaust pipe, the spray manifold can be pulled out of the exhaust duct during the normal cooking cycle, being stored in a lateral entry chute.

A collection trough and suitable baffles are located in the hood of the exhaust system to collect the spent cleaning liquid and dispose of it to a drain or other collection medium.

BRIEF DESCRIPTION OF THE DRAWING

The advantages of the present invention will be more apparent from the following detailed description when considered in connection with the accompanying drawing wherein.

DESCRIPTION OF THE PREFERRED EMBODIMENTS

Figure 1:
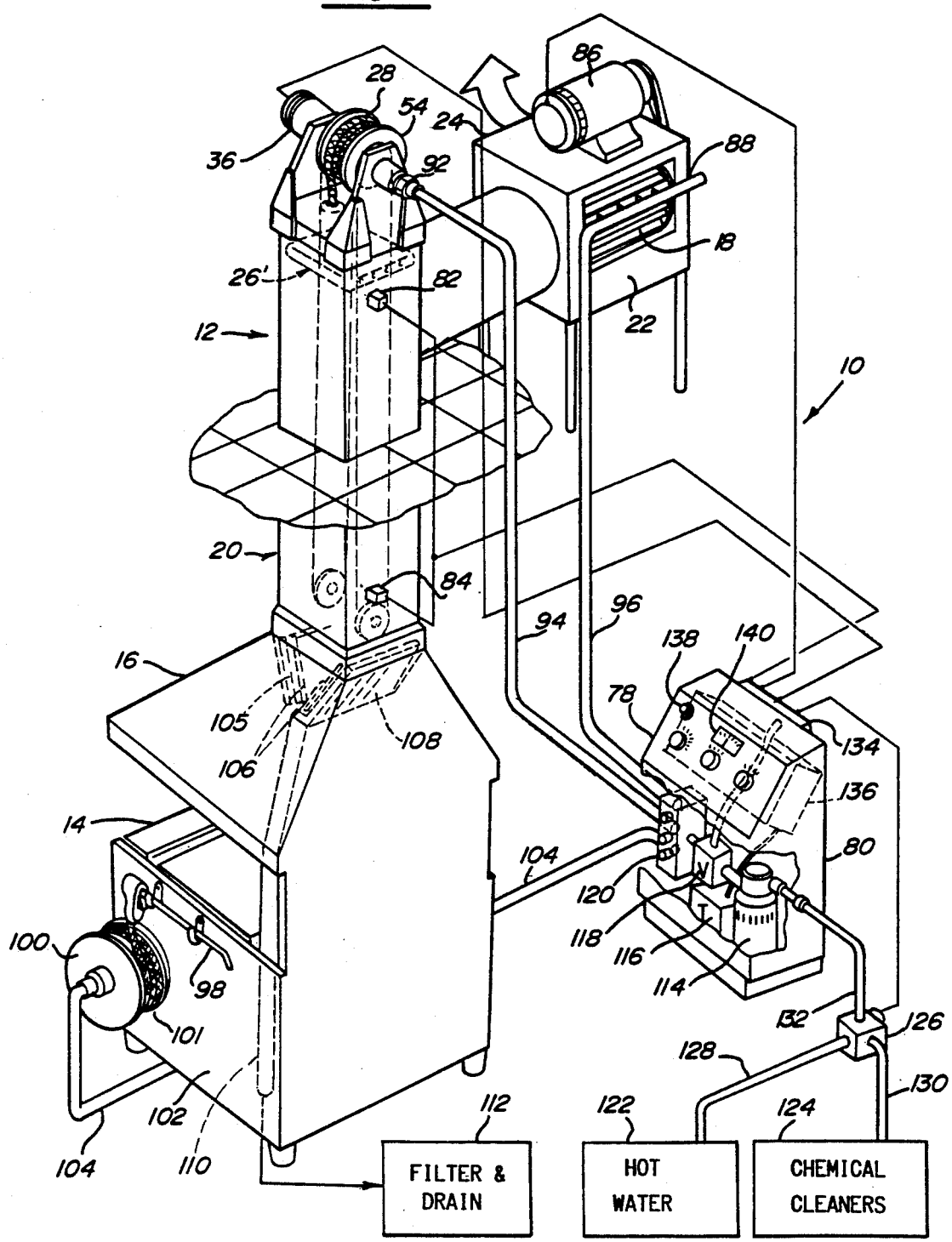
FIG. 1 is a perspective view of the overall cleaning system of this invention showing the spray nozzle manifold located in a vertically oriented exhaust duct with a means for delivering hot cleaning fluid to the manifold and for moving the manifold along the length of the duct and for disposing of the spent cleaning liquid to drain in a cycle predetermined by the automatic control.

Referring to FIG. 1 of the drawing, the exhaust duct cleaning system 10 of this invention is shown applied to an exhaust system 12 associated with a cooking range 14. The grease vapors released during cooking are collected in a hood 16 and are drawn through the exhaust system 12 by fan 18. The exhaust system is seen as including a vertical duct 20 connected at its upper end to a lateral fan intake duct 22 through which the exhaust fumes are drawn by the fan 18 exiting at 24. It will be appreciated that the cleaning system 10 of the invention can be applied to horizontal ducts, slanted ducts and ducts having round and other cross sectional shapes. It should also be appreciated that the duct cleaning system can be applied where the exhaust fan 18 is in line with the main exhaust duct 20 with modifications to be explained later.

As the cooking fumes are drawn through the exhaust system, the grease and other solid and liquid waste material condenses and deposits on the entire internal perimeter of the exhaust system, primarily in the initial vertical duct 20.

Figure 2:
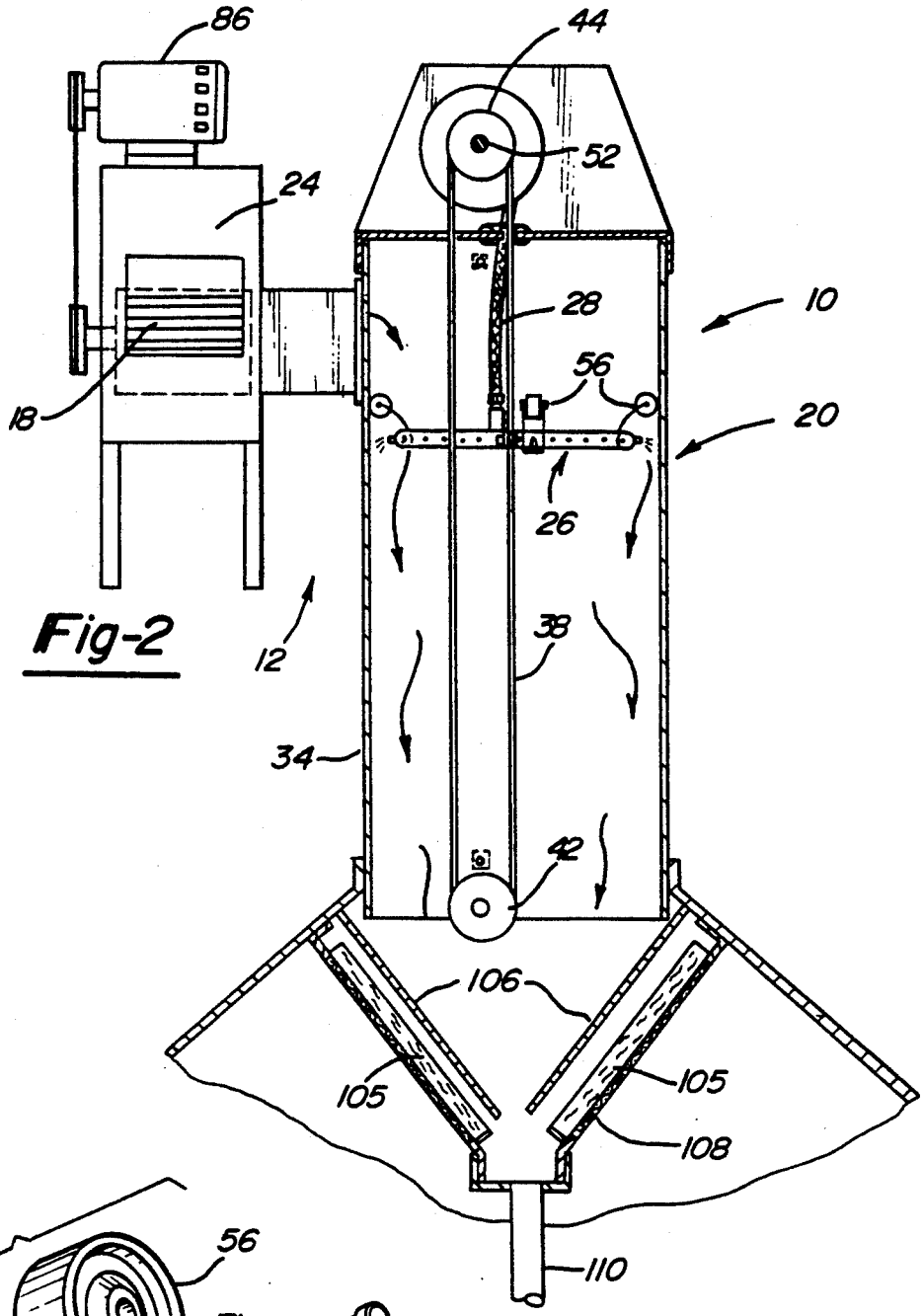
FIG. 2 is a side elevation of the vertical exhaust duct of FIG. 1 partially in cross section showing the means for supporting the spray manifold within the duct and for moving it up and down to completely clean the duct interior as well as the baffling and the collecting trough for collection of the spent cleaning fluid.
Figure 3:
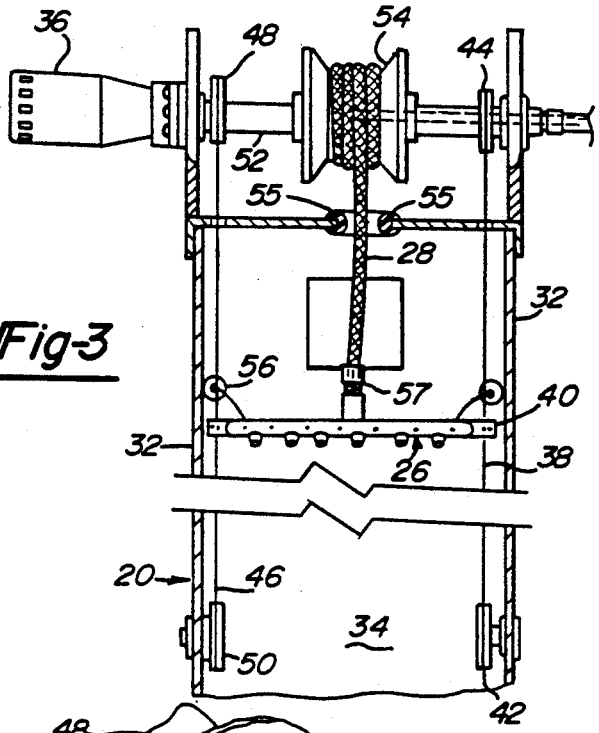
FIG. 3 is an end elevational view partially in section of the vertical exhaust duct with portions broken away further illustrating the drive system and method of guiding the hose for the high pressure liquid supplied to the manifold.
Figure 4:
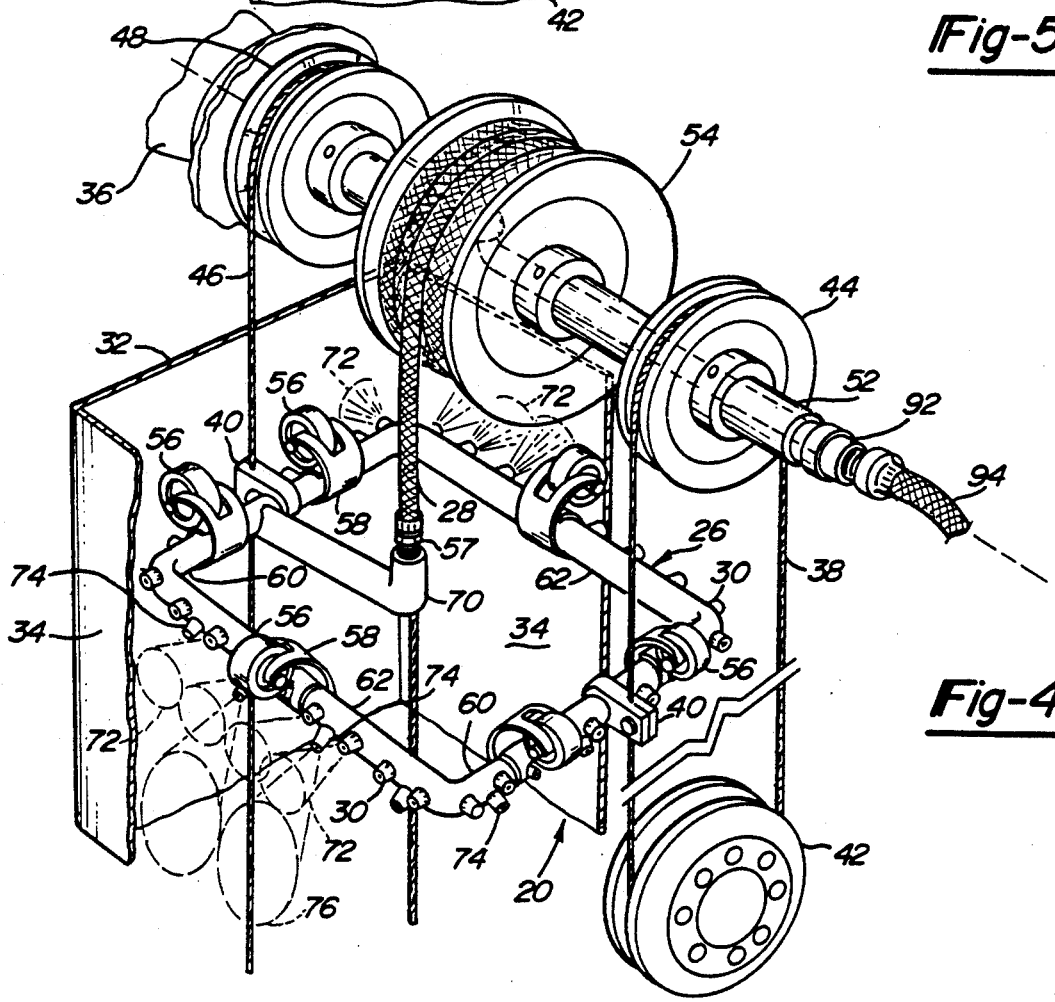
FIG. 4 is an enlarged perspective view of the upper half of the vertical duct showing the details of the spray manifold and its method of support within the vertical duct.

Referring additionally to FIGS. 2–4, a cleaning liquid manifold 26 is constructed to conform to the internal perimeter of duct 20. The manifold 26 is supplied with hot pressurized cleaning liquid through a hose 28, and the cleaning liquid is dispersed through high pressure nozzles 30 on the manifold to impinge upon the internal surfaces of opposed vertically extending lateral and transverse duct walls 32 and 34. The nozzles 30 are spaced on the manifold 26 so as to optimize cleaning liquid distribution, assuring that the internal walls are fully covered by the spray as indicated by spray patterns 72 shown in phantom in FIGS. 4 and 5.

The manifold 26 is caused to descend from its rest or storage position shown at 26' in FIG. 1 above the level of lateral fan intake duct 22 to the bottom of the duct and to return or ascend upwardly by motor 36 so as to expose the entire internal surfaces of the duct to the cleaning liquid spray. As shown best in FIGS. 3 and 4, manifold 26 is moved by cable 38 attached to manifold 26 through clamp member 40 and driven by upper pulley 44 in an endless loop and trained around lower pulley 42. For stability, a second cable 46 and upper and lower pulleys 48 and 50 have been added adjacent to the opposed lateral side wall 32. Upper pulleys 44 and 48 are located on shaft 52 driven by motor 36, the shaft carrying hose reel 54. Thus the hose 28 is payed out and reeled up at the same rate that the manifold 26 is being moved through cable 38. Guide limit rollers 55 are used between the reel 54 and the hose connection 57 to the manifold 26. Such constant hose feed and guiding are desirable since the hose is carrying hot high pressure liquid.

It will be readily apparent that several equivalent manifold drive arrangements are possible. For example, the manifold 26 can be weighted so that the downward movement is powered by gravity, and motor 36 on shaft 52 will be used only to retract the manifold by taking up the hose 28 on reel 54. Thus, both cables 38 and 46 could be eliminated along with their corresponding pulleys. In some cases it may be desirable, and if space permits, to locate the motor 36 on a lower shaft. In other cases only the drive cable will be used and the stabilizing cable 46 will be eliminated. Either or both of the cables 38 and 46 can be double ended (not an endless loop) with an appropriate cable take up mechanism. One or both of the cables 38 and 46 with their corresponding pulleys 42, 44 and 48, 50 can be located outside of the duct walls.

When the exhaust fan 18 is located in the upper end of exhaust duct 20, the manifold 26 will preferably be withdrawn from the duct through an access door, not shown, in one of the two wider lateral side walls 32.

Figure 6:
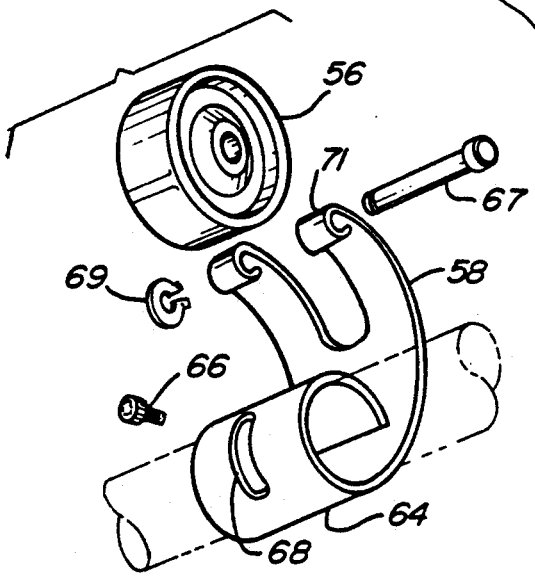
FIG. 6 is an exploded perspective view of the guide roller mounting means show in FIG. 5.
Figure 5:
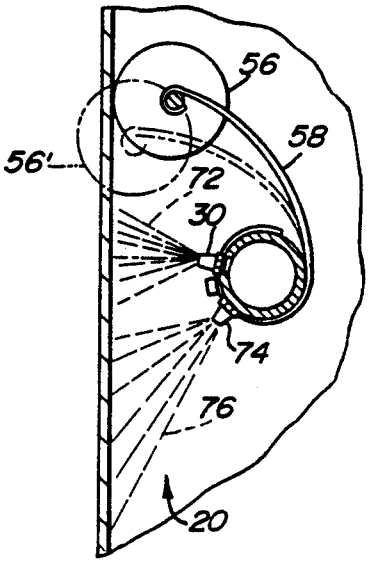
FIG. 5 is a partial cross sectional view on an enlarged scale showing the location of nozzles on the manifold and their dispersion pattern along with the method of mounting the guide rollers to the manifold.

In order to keep the spray manifold 26 centered in the duct 20 at least one roller 56 mounted on the manifold 26 is caused to ride against each of the lateral and transverse side walls 32 and 34. Preferably rollers 56 are spring loaded as by the use of spring clips 58 as shown in FIGS. 4–6. Spring clips 58 are mounted to the lateral pipe section 60 and transverse pipe sections 62 by forcing the pipe into curved or looped section 64 of the clip and securing it to the manifold in a selected position with the use of a set screw 66 inserted through slot 68. Roller 56 is retained on the clip 58 by pin 67 and snap ring 69 with the pin 67 being held in retention ends 71 of the clip. The spring force exerted by the roller 56 is controlled by the positioning of the clip 58 on the individual pipes 60 and 62, held in the selected position by set screw 66 in slot 68. The phantom position of roller 56′ shows a theoretical relaxed position of the roller to indicate the degree of force adjustment available. In the embodiment illustrated in FIG. 4, two rollers 56 are used to guide against the opposed wider lateral side walls 32, and one roller 56 is used against each of the narrower opposed transverse side walls 34.

As shown in FIG. 4 the spray manifold 26 is formed from a continuous piece of tubing bent at four corners and joined together to form the opposing lateral pipe portions 60 and transverse pipe portions 62. Alternatively, separate straight pipe portions 60 and 62 can be joined by elbows or the entire manifold can be molded plastic. Inlet pipe 70 can be integrally molded with the manifold or joined thereto as is suitable. The individual nozzles 30 are preferably threaded into manifold 26 so that they can be easily replaced. As previously noted these nozzles are pointed directly at the duct side walls issuing a spray pattern 72 which touches or overlaps the adjacent spray pattern. Additional nozzles 74 can also be supplied on the manifold 26 at larger spacing than that of nozzles 30 with the nozzle pointed downwardly so as to create a larger spray pattern 76 which touches the spray pattern from adjacent nozzle 74. These nozzles 74 can then be used to supply hot water and chemical solvents at a lower pressure to wet down the duct walls while the nozzle pipe remains stationary or in an initial traverse of the nozzle pipe through the duct to initiate a softening or soak cycle before the high pressure cycle, all in accordance with a preset program in controller 136 or a program initiated on the control panel 78 of control unit 80. The vertical travel limits of the manifold 26 can be controlled by proximity switches 82 and 84 located at the upper and lower ends respectively of the duct 20. These proximity switches are tied into the control unit 80 by control lines as shown in FIG. 1 along with the manifold drive motor 36 and the blower motor 86.

A fixed spray manifold 88 can be supplied adjacent to the inlet of fan 88 to spray cleaning against the fan blades for a portion of the cleaning cycle. Cleaning liquid is supplied to manifold 26 through hose 28, connection 57 and inlet pipe 70 through connection 92 and line 94 extending to the control unit 80. Similarly cleaning liquid is supplied to the fixed nozzle pipe 88 through line 96 connected to the control unit 80. Hand operated wash down gun 98 can be mounted with its hose reel 100 on the side 102 of the cooking range 14 or on a wall to selectively wash down portions of the hood 16 or the exhaust duct 20. Cleaning liquid is supplied to gun 98 through hose 101 and line 104 also connected to control unit 80.

Spent cleaning fluid as it flows from the bottom of duct 20 will be deflected by baffles 106 into a collection trough 108 to be directed by drain line 110 to a filter and drain 112 as shown in FIG. 1. Replaceable air filters 105 are located as shown in FIGS. 1 and 6 in trough 108. The flow of spent cleaning fluid from nozzle spray manifold 26 will be along duct walls 32 and 34, baffles 106 into collection trough 108. The flow of spent cleaning fluid from nozzle pipe 88 will be along the lower wall of lateral fan duct 22 and primarily along one of the transverse walls 34 of vertical duct 20 to the collection trough 108.

The control unit 80 not only automatically controls operation of the cleaning system 10 on a predetermined periodic cycle but also conveniently houses the cleaning liquid pump 114, timer 116, solenoid or motor operated valve system 118 and internal manifolding 120 to the cleaning fluid lines 94, 96 and 104. Hot water is supplied from a source 122, usually the restaurant or establishment hot water tank, and cleaners are supplied from source 124, usually a tank or drum, to an automatic shut off and mixing valve 126 by lines 128 and 130 respectively. Hot water and cleaners are supplied from automatic valve 126 to pump 114 by line 132.

The cleaners from source 124 can be a suitable combination of detergents, soaps, rust inhibitors, antifreeze solutions and the like which can be varied depending upon the type of grease being removed and the cycle selected.

The control lines to manifold drive motor 36, limit or proximity switches 82 and 84, fan motor 86 and mixing valve 126 are connected to terminal 134 of control unit 80. The cleaning is automatically operated by the controller 136 according to a predetermined cycle which can be modified according to the control knobs on control panel 78 or manually operated thereby such as the operation of wash down gun 98. Various indicators can be used such as operating light 138 and cleaning fluid pressure gauge 140 to indicate the condition and aid in changing the program of the controller.

The interval between cleaning cycles is selected so complete grease removal can be obtained. The cycle can be a daily, weekly, semi monthly or other time cycle consistent with buildup rates and normal operation of the cooking range 14. A number of passes may be necessary for complete cleaning of exhaust duct 20. An initial vertical pass can, for example, be made to supply a hot water/detergent mixture to the walls for a presoak or softening period. Cleaning fluid pressure may be reduced for this initial pass to some low value such as street pressure which may be 60 p.s.i. or hot water supply pressure, and the bulk or all of the fluid will be supplied through wider coverage nozzles 74 in the wider spray pattern 76 shown in FIGS. 4 and 5. The grease removal may be done in one or more passes where a hot water/detergent mixture at a high pressure such as 600 p.s.i. will produce high energy jets to impinge on relatively smaller areas 72 from the nozzles 30. Valving, not shown, can be used to provide selectivity between nozzles 30 and 74, or this can be accomplished by nozzle design alone or in combination with pressure changes. Also additional valving and hoses 28 can be used to selectively operate individual pipes 60 and 62 of manifold 26 or portions thereof where large exhaust duct sizes are accommodated with low capacity pumps.

Finally a hot water rinse pass at high or low pressure can be used.

The preferred, but optional, fan cleaning portion of the system can be programmed to precede the vertical duct cleaning passes since it is desirable to run the fan 86 while cleaning fluid is being sprayed from nozzle pipe 88 in order to impinge upon the fan blades. Sequential operation is also preferable to conserve the capacity of the high pressure pump.

It will be apparent that the cleaning cycle can be widely varied to suit the installation or changes in conditions.

The embodiments of the invention in which an exclusive property or privilege is claimed are defined as follows:

1. A cleaning system for use in an exhaust duct of a cooking unit comprising, in combination:

a manifold conforming to an internal perimeter of said exhaust duct;

delivery means for supplying cleaning liquid under pressure to said manifold;

motor means for moving said manifold along the length of said duct;

a plurality of nozzles on said manifold for directing said cleaning liquid against the internal perimeter of said exhaust duct as said manifold is moved in said duct; and wherein said exhaust duct is a vertical duct connected at its lower end to an exhaust hood, and a collection trough is located within said hood to direct spent cleaning liquid to drain;

whereby grease and the like is washed from the inside of said exhaust duct and delivered to said drain.

2. The cleaning system according to claim 1, wherein said delivery means includes a pump for delivering hot water to said manifold.

3. The cleaning system according to claim 2, wherein said delivery means includes means for supplying chemical cleaners such as detergents, rust inhibitors and the like with said hot water for supplying cleaning liquid to said manifold.

4. The cleaning system according to claim 3, wherein an automatic control unit operates said delivery means and motor means on a predetermined cycle.

5. The cleaning system according to claim 1, wherein said exhaust duct has a proximity switch adjacent its lower and upper ends, said proximity switches being connected to an automatic control unit for controlling movement of said manifold up and down in said duct.

6. The cleaning system according to claim 1 wherein said exhaust duct is connected with an exhaust fan, and a distribution pipe containing a plurality of nozzles is located adjacent said fan for directing cleaning liquid toward said fan.

7. The cleaning system according to claim 6, wherein said automatic control unit operates said exhaust fan and controls flow of cleaning liquid from said delivery means to said distribution pipe on a predetermined cycle.

8. The cleaning system according to claim 1 further including a washdown gun connected with said delivery means and an automatic control unit for manual operation of said washdown gun.

9. The cleaning system according to claim 1, wherein said delivery means and said motor means includes a hose and take-up reel for said hose.

10. The cleaning system according to claim 9, wherein said motor means includes a cable and pulley drive system.

11. The cleaning system according to claim 1, wherein said manifold is positioned by guide rollers acting against the internal perimeter of said exhaust duct.

12. The cleaning system according to claim 11, wherein said guide rollers are spring-loaded against the internal perimeter of said exhaust duct.

13. The cleaning system according to claim 11, wherein said exhaust duct is rectangular and at least one guide roller acts against each wall of said duct.

14. A cleaning system for use in an exhaust duct of a cooking unit comprising, in combination:

a manifold conforming to an internal perimeter of said exhaust duct;

delivery means for supplying cleaning liquid under pressure to said manifold including a pump for delivering hot water to said manifold and means for supplying chemical cleaners such as detergents, rust inhibitors and the like with said hot water;

motor means for moving said manifold along the length of said duct;

an automatic control unit for operating said delivery means and motor means on a predetermined cycle;

a plurality of nozzles on said manifold for directing said cleaning liquid against the internal perimeter of said exhaust duct as said manifold is moved in said duct; and wherein said exhaust duct extends vertically having a proximity switch adjacent its lower and upper ends, said proximity switches being connected to said automatic control unit for controlling movement of said manifold up and down in said duct;

whereby grease and the like is washed from the inside of said exhaust duct.

15. A cleaning system for use in an exhaust duct of a cooking unit comprising, in combination:

a manifold conforming to an internal perimeter of said exhaust duct;

delivery means for supplying cleaning liquid under pressure to said manifold including a pump for delivering hot water to said manifold and means for supplying chemical cleaners such as detergents, rust inhibitors and the like with said hot water;

motor means for moving said manifold along the length of said duct;

an automatic control unit for operating said delivery means and motor means on a predetermined cycle;

a plurality of nozzles on said manifold for directing said cleaning liquid against the internal perimeter of said exhaust duct as said manifold is moved in said duct; and wherein said exhaust duct is connected with an exhaust fan, and a distribution pipe containing a plurality of nozzles is located adjacent said fan for directing cleaning liquid toward said fan;

whereby grease and the like is washed from the inside of said exhaust duct.

16. The cleaning system according to claim 15, wherein said automatic control unit operates said exhaust fan and controls flow of cleaning liquid from said delivery means to said distribution pipe on a predetermined cycle.

17. A cleaning system for use in an exhaust duct of a cooking unit comprising, in combination:

a manifold conforming to an internal perimeter of said exhaust duct;

delivery means for supplying cleaning liquid under pressure to said manifold including a pump for delivering hot water to said manifold and means for supplying chemical cleaners such as detergents, rust inhibitors and the like with said hot water;

motor means for moving said manifold along the length of said duct;

an automatic control unit for operating said delivery means and motor means on a predetermined cycle;

a plurality of nozzles on said manifold for directing said cleaning liquid against the internal perimeter of said exhaust duct as said manifold is moved in said duct; and a washdown gun connected with said delivery means and said automatic control unit for manual operation of said washdown gun;

whereby grease and the like is washed from the inside of said exhaust duct.

* * * * *